US006371364B1

(12) United States Patent
Maillot et al.

(10) Patent No.: US 6,371,364 B1
(45) Date of Patent: Apr. 16, 2002

(54) CELLULAR PLASTIC PACKAGING CONTAINER AND ASSEMBLY COMPRISING SUCH A CONTAINER AND ITS LID

(75) Inventors: Guillaume Maillot, Colmar; Gilles Bedez, Lapoutroie; Daniel Baumann, Wintzenheim; Lucien Heckly, Kientzheim; Gerard Beigue, Ingersheim, all of (FR)

(73) Assignee: Kaysersberg Packaging, Kunheim (FR)

( * ) Notice: Subject to any disclaimer, the term of this patent is extended or adjusted under 35 U.S.C. 154(b) by 0 days.

(21) Appl. No.: 09/445,959

(22) PCT Filed: Apr. 15, 1999

(86) PCT No.: PCT/FR99/00889

§ 371 Date: Jun. 8, 2000

§ 102(e) Date: Jun. 8, 2000

(87) PCT Pub. No.: WO99/54224

PCT Pub. Date: Oct. 28, 1999

(30) Foreign Application Priority Data

Apr. 17, 1998 (FR) ..... 98 04868

(51) Int. Cl.[7] ..... B65D 43/03; B65D 43/06

(52) U.S. Cl. ..... 229/114; 206/508; 206/518; 220/657; 220/796; 229/125.19; 229/125.22; 229/171

(58) Field of Search ..... 229/5.5, 114, 125.19, 229/125.22, 171, 406, 407, 915; 206/508, 511, 512, 515, 518; 220/656, 657, 796

(56) References Cited

U.S. PATENT DOCUMENTS

| | | | | | |
|---|---|---|---|---|---|
| 2,056,297 | A | | 10/1936 | Rood | |
| 2,476,583 | A | | 7/1949 | Burgoon | |
| 2,585,180 | A | * | 2/1952 | Smith | 206/508 |
| 2,944,721 | A | | 7/1960 | Choate | |
| 3,117,692 | A | * | 1/1964 | Carpenter et al. | 206/508 |
| 3,338,468 | A | * | 8/1967 | Wilson | 206/508 |
| 4,018,338 | A | * | 4/1977 | Lemkin | 206/508 |

FOREIGN PATENT DOCUMENTS

| | | |
|---|---|---|
| FR | 936324 | 7/1948 |
| WO | WO 96/23646 | 8/1996 |

* cited by examiner

*Primary Examiner*—Gary E. Elkins
(74) *Attorney, Agent, or Firm*—Young & Thompson

(57) ABSTRACT

Packing box (2) of polygonal general shape that widens out, is made from a flat cellular plastic blank that is cut and folded. The box (2) comprises a base (4) and side walls (5, 6) which are formed from side panels of the blank and are joined together, and an outer reinforcing frame (7), used for holding the box. The frame runs around the side walls (5, 6) and comprises frame members (8, 9) joined together and fixed to the side walls (5, 6). The frame members are formed from at least four flaps extending from side panels of the blank and rolled up spiral-fashion.

17 Claims, 4 Drawing Sheets

CELLULAR PLASTIC PACKAGING CONTAINER AND ASSEMBLY COMPRISING SUCH A CONTAINER AND ITS LID

CROSS REFERENCE TO RELATED APPLICATION

This is the 35 USC 371 national stage of international application PCT/FR99/00889 filed on Apr. 15, 1999 which designated the United States of America.

FIELD OF THE INVENTION

The present invention relates to a packing box.

The invention relates in particular to the transport of airmail.

BACKGROUND OF THE INVENTION

Such boxes, designed to contain mail, must be reusable, lightweight and stiff, have high mechanical strength, be moisture-resistant, and be easy to handle and store.

SUMMARY OF THE INVENTION

The object of the invention is to provide a packing box that is relatively easy to produce, is of low cost and satisfies the requirements stated above.

To this end the subject of the invention is a packing box of polygonal general shape that widens out, made from a flat cellular plastic blank that is cut and folded, comprising, on the one hand, a base and side walls, these walls being formed from side panels of the blank that are joined together and, on the other hand, an outer reinforcing frame, used for holding the box, that runs around the side walls and comprises frame members joined together and fixed to the side walls.

In certain particular embodiments, the box may comprise one or more of the following features, taken in isolation or in all technically possible combinations:

- the frame members are formed from folded flaps extending from side panels of the blank;
- at least two adjacent side panels are joined together by means of a tongue extending from one of these side panels;
- this tongue is folded and fixed to the other of these side panels by a weld, such as one produced by hot plate welding or by hot air;
- the frame members are joined together by a weld, such as one produced by hot plate welding;
- reliefs used for holding the box are provided on frame members;
- the blank comprises two outer sheets and an ordered and oriented inner insert arranged between the sheets with which it defines a plurality of cells, and this insert is oriented approximately in the transverse direction of the base of the box;
- the thickness of the outer frame is adapted so that it rests on the outer frame of another box when such empty boxes are stacked;
- the blank is a cellular polypropylene blank; and
- the base has dimensions of approximately 400 mm×252 mm, the height of the box is approximately 185 mm, the frame has external dimensions of approximately 480×325 mm, and the frame members have a height of approximately 45 mm and a thickness of approximately 20 mm.

The invention also relates to an assembly comprising a box as defined above and a lid for closing this box, the lid comprising a board and a peripheral rim adapted to surround with slight play the outer reinforcing frame, used for holding the box, when the latter is closed by the lid.

In certain particular embodiments, the assembly may possess one or more of the following features, taken in isolation or in all technically possible combinations:

- the board of the lid is provided on its outer face with locating stops designed to surround with slight play the base of another box and thus allow several boxes closed by their lids to be stacked;
- the rim of the lid widens out away from the latter and the board of the lid has recesses on its inner face to house locating stops of another lid to enable several lids to be stacked;
- the outer face of the board of the lid includes a sunken area with reliefs to limit adhesion to it; and
- the lid includes reliefs or depressions to guide the binding straps.

BRIEF DESCRIPTION OF THE DRAWINGS

A clearer understanding of the invention will be derived from a reading of the following description, which is provided purely by way of example and refers to the accompanying drawings in which.

DETAILED DESCRIPTION OF THE INVENTION

Figure 1:
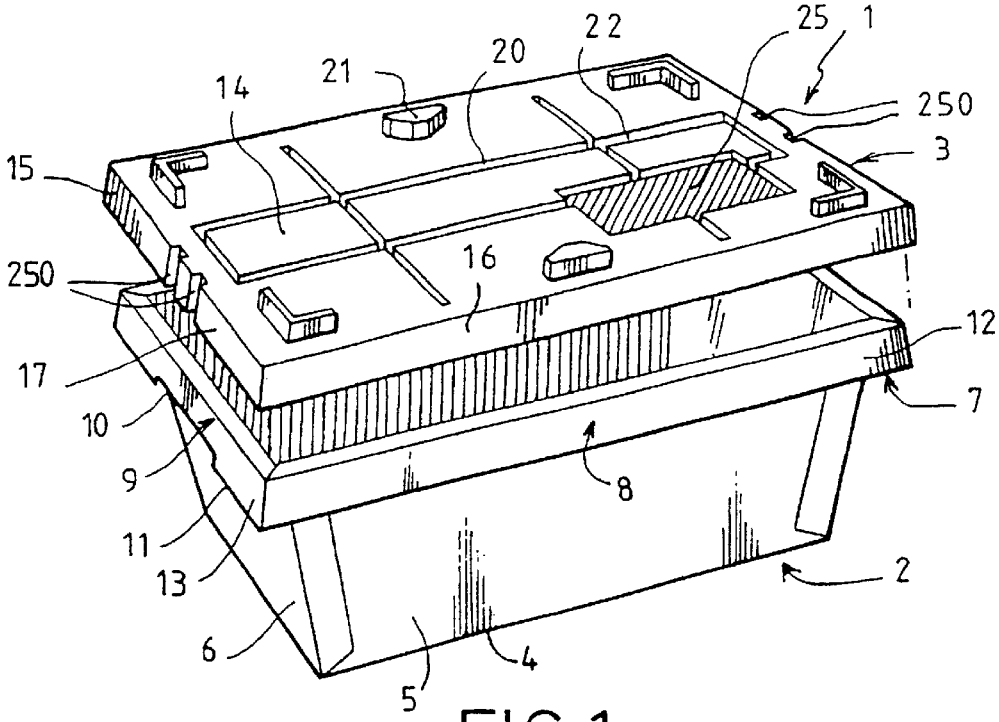
FIG. 1 is a perspective view of a mail box and its lid according to the invention.

FIG. 1 shows an assembly 1 comprising a mail box 2 and its lid 3. The mail box 2 is in the general shape of a truncated pyramid that widens out away from the box, that is to say upwards in FIG. 1.

This box 2 comprises a rectangular base 4, two longitudinal side walls 5 and two transverse side walls 6. This box 2 also comprises a reinforcing frame 7, used to hold the box, that runs around the outside of the side walls 5 and 6. This frame 7 is composed of two longitudinal frame members 8, fixed to the upper edges of the side walls 5, and two transverse frame members 9 fixed to the upper edges of the side walls 6.

Figure 4:
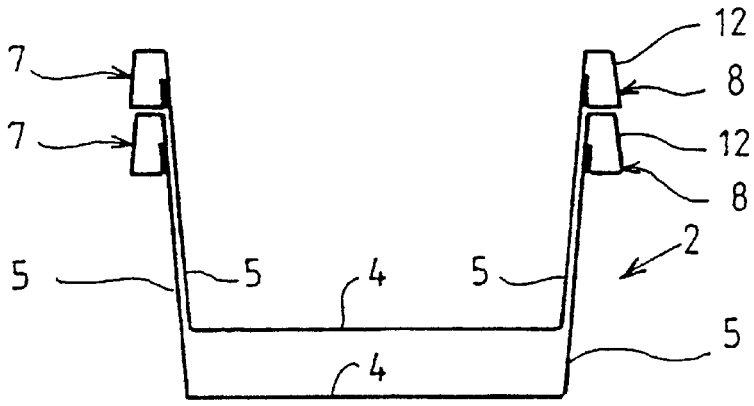
FIG. 4 is a schematic cross section illustrating the stacking of empty boxes similar to that of FIG. 1.

The frame members 8 and 9 are of hollow, generally trapezoidal section, as can be seen in FIG. 4. Each transverse frame member 9 incorporates a central recess 10 in the lower surface 11 of this frame member 9 to facilitate gripping the box 2.

In an alternative embodiment that is not illustrated, the box 2 includes reinforcing inserts, e.g. of hard polyurethane foam, inside these frame members 8 and 9.

The outer lateral surfaces 12 of the frame members 8 converge away from the box 2, i.e. upwards in FIG. 1. The outer lateral surfaces 13 of the frame members 9 converge away from the box 2.

Figure 5:
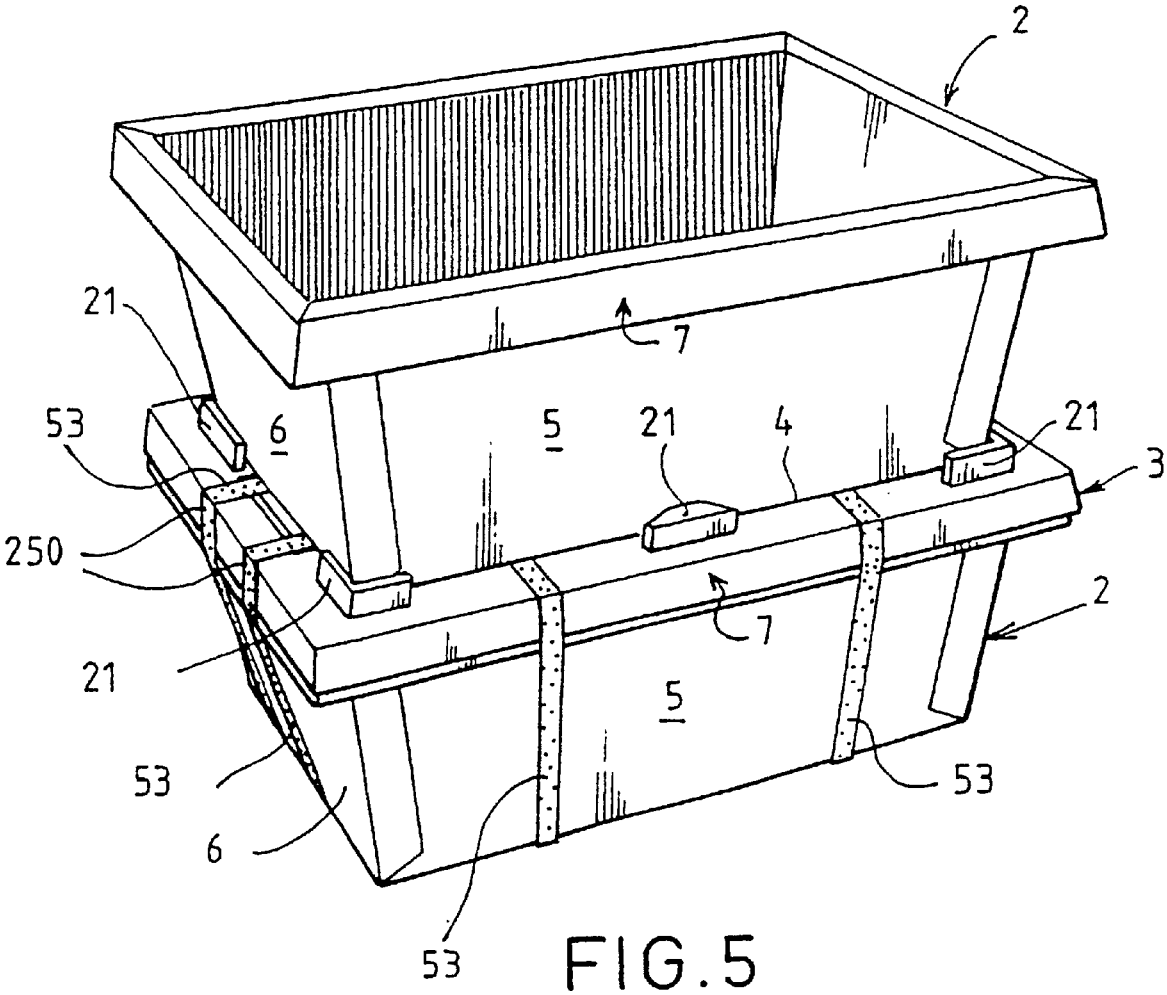
FIG. 5 is a perspective view showing the stacking of full boxes closed by their lids and similar to that of FIG. 1.
Figure 6:
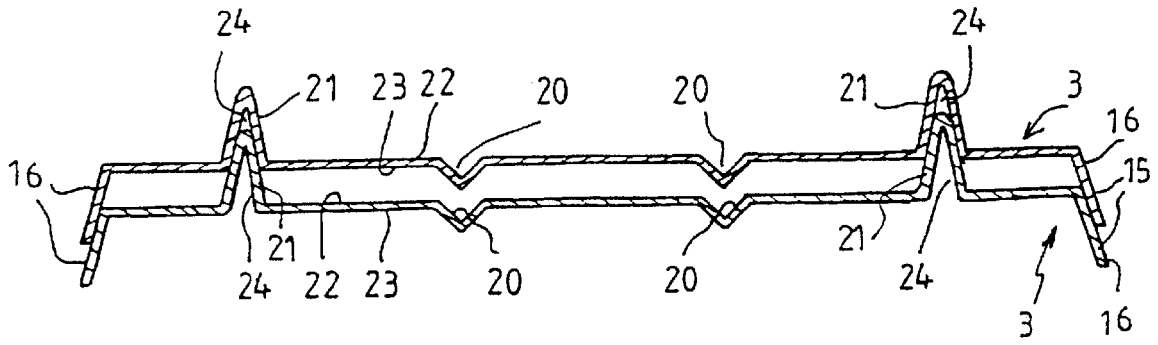
FIG. 6 is a schematic cross section showing the stacking of lids similar to that of FIG. 1.

The lid 3 comprises a generally rectangular central board 14 and a peripheral rim 15 which slightly widens out away from the lid 3 (FIG. 6). This rim 15 is adapted to surround with slight play the frame 7 when the lid 3 closes the box 2 (FIG. 5). This rim 15 comprises two longitudinal sections 16 and two transverse sections 17 whose slopes correspond to those of surfaces 12 and 13, respectively, of the frame 7 with which they come into contact when the box 2 is closed by its lid 3.

The lid 3 may be formed, for example, from solid thermoformed or injected opaque or transparent plastic material such as a polyolefin or a polycarbonate. The box 2 is made from a flat cellular polypropylene blank as described below.

The central board 14 comprises depressions and reliefs including longitudinal and transverse grooves 20 and peripheral locating stops 21 on its outer face 22 (at the top in FIG. 1).

The stops 21 are generally shaped so as to converge outwards and define between themselves a rectangular area slightly larger than the area of the base 4 of the box 2.

The inner face 23 of the board 14 comprises recesses 24 which match the stops 21 (FIG. 6).

The outer face 22 also comprises a sunken area 25 with striations running obliquely to the longitudinal direction of the board 24.

Two shallow longitudinal parallel slots 250 are provided in a central area of each transverse section 17 of the rim 15.

Figure 2:
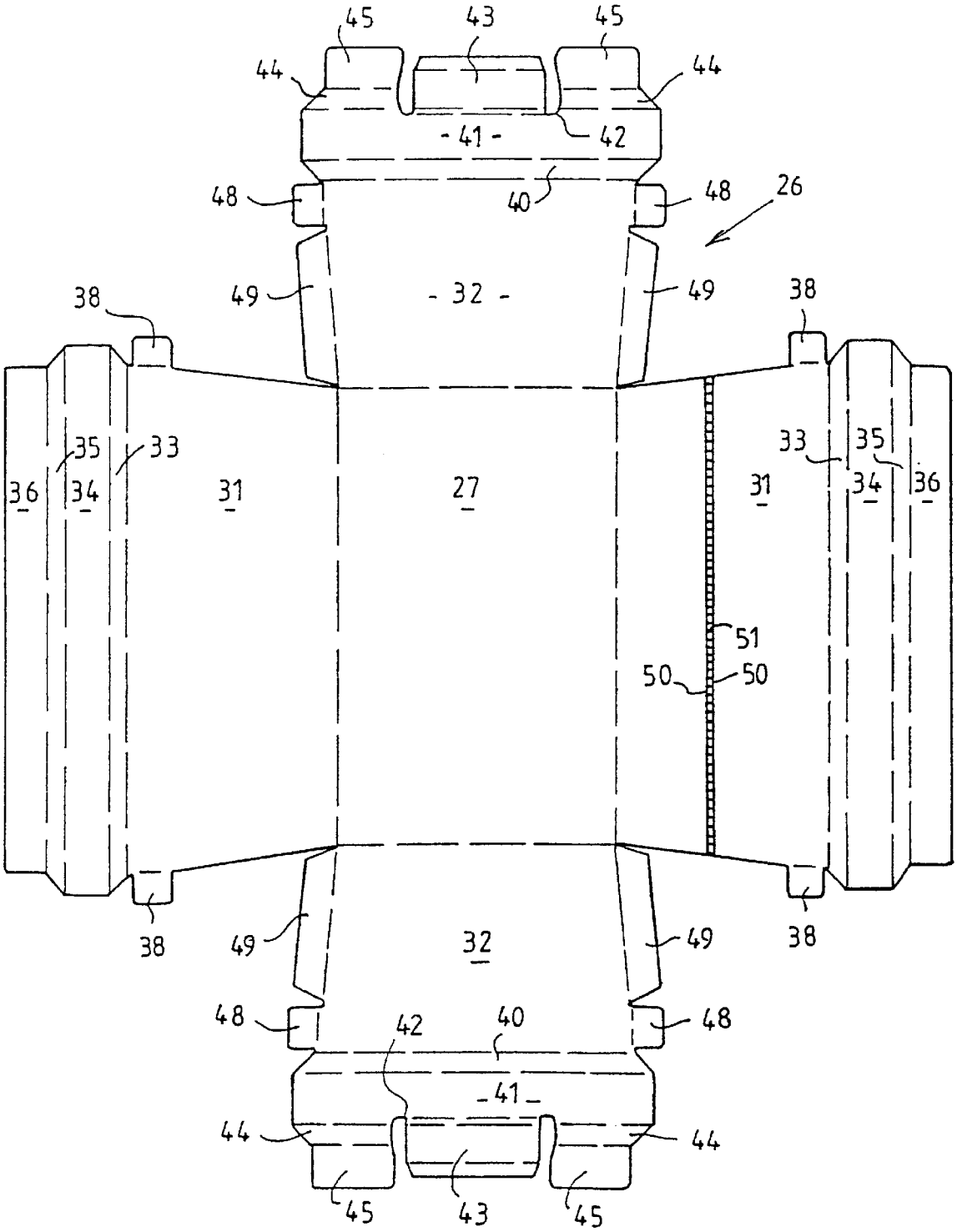
FIG. 2 is a plan view of a blank from which the box of FIG. 1 can be made.

The box 1 is made from a flat cellular polypropylene blank 26 illustrated in FIG. 2. This blank 26, which is roughly in the shape of a cross, is precut and scored to enable it to be folded.

This blank 26 comprises a rectangular central board 27 corresponding to the base 4 of the box 2, two longitudinal side panels 31 corresponding to the walls 5, and two transverse side panels 32 corresponding to the walls 6.

Each generally trapezoidal panel 31 is joined by its short base to the panel 27 and extended, along its long base, by four successive flaps 33 to 36, so as to form a frame member 8 as described below.

The flaps 33 and 35 are trapezoidal and the flaps 34 and 36 are rectangular. Two small tabs 38 are provided on the oblique sides of each panel 31, next to its long base.

Each generally trapezoidal panel 32 is joined by its short base to the panel 27 and extended, along its long base, by two successive flaps 40 and 41. The flap 40 is trapezoidal and the flap 41 is approximately rectangular. A central notch 42 is formed on the long side of each flap 41 furthest from the central panel 27. Each flap 41 is extended in this notch 42 by a double flap 43. The flap 41 is also extended on either side of the notch 42 by two successive flaps 44 and 45.

Each panel 32 is also provided on its oblique sides with two small tabs 48 close to its long base, and with two long tongues 49 along the rest of the length of its oblique sides.

The blank 26 consists, as illustrated in the revolved section in FIG. 2, of two flat outer sheets 50 and an ordered and oriented inner insert arranged between the sheets 50. This inner insert comprises approximately straight parallel webs 51 which, with the sheets 50, define cells. The webs 51 are oriented transversely to the panels 27 and 31. Other inner inserts such as for example a corrugated sheet, or non-ordered inserts, may be used.

The sectional structure of the blank 26 is not shown in FIG. 4 which is a schematic section.

The blank 26 is used to make the box 2 by folding as will now be described with reference to FIGS. 1, 2 and 3.

Figure 3:
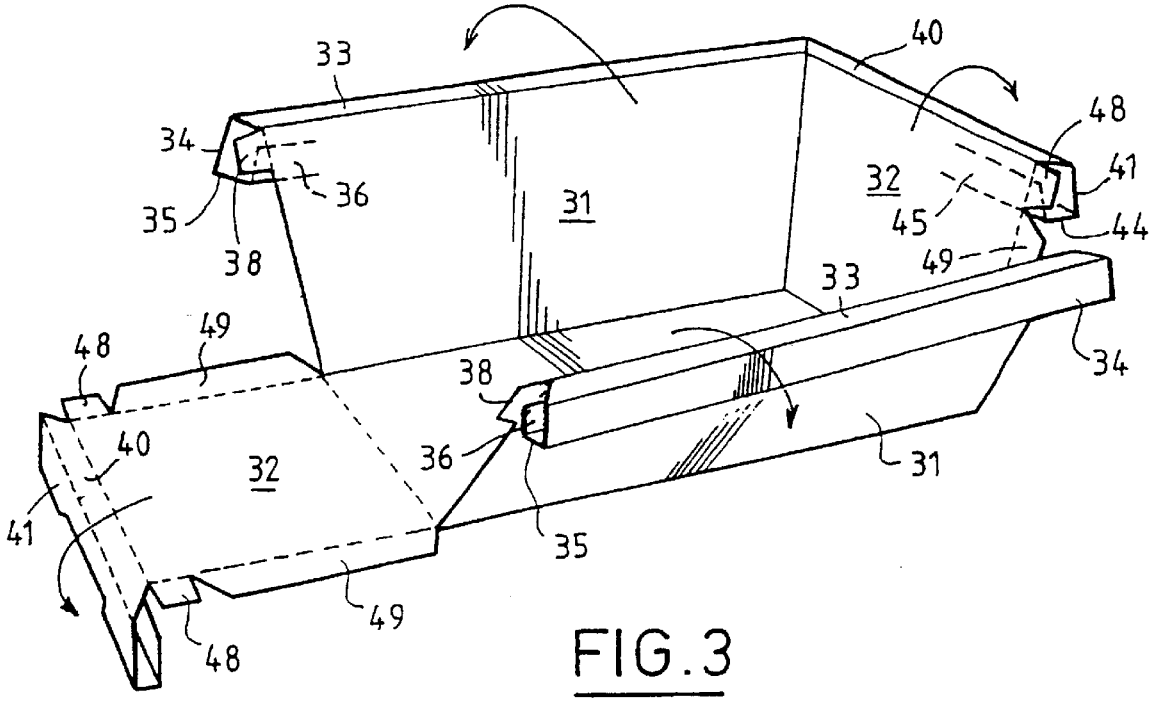
FIG. 3 is a perspective view showing schematically the production of the box of FIG. 1 from the blank of FIG. 2.

The process may be begun by folding, for each flap 31, the flaps 33 to 36, bringing the flap 36 round onto the panel 31 inside the resulting fold (see the arrows in FIG. 3). The sides of the flap 36 are then covered by folding the tabs 38. The flaps 33 to 36 are fixed in this position, folded into a sort of spiral or "snail" by welding the flap 36 to the panel 31 and the tabs 38 to the flap 36. The longitudinal frame members 8 are thus formed.

Next, by way of example, the double flap 43 of each panel 32 is folded over onto the flaps 41 and 40 in order to line them directly beneath the notch 42. The flaps 40, 41, 44 and 45 are then folded by bringing the flaps 45 against the panel 32 inside the resulting fold (see the arrows in FIG. 3). The sides of the flaps 45 are then covered with the tabs 48. The flaps 40, 41, 44 and 45 are fixed in this position, folded into a sort of spiral or "snail" by welding the flaps 45 to the panel 32 and the tabs 48 to the flaps 45. This forms the transverse frame members 9.

Next, the box 2 is formed into shape by joining each panel 32 to two panels 31 by fixing, e.g. welding, each tongue 49 to the edge of the adjacent panel 31.

Lastly, the ends of the frame members 8 are welded to the ends of the frame members 9.

Manufacture of the box 2 is relatively easy and can be fully automated.

The welding spoken of for forming the frame members 8 and 9 and fixing the tongues 49 to the panels 31 may for example be done with the aid of hot air nozzles, by ultrasound or by hot plate welding, that is to say by interposing a hot plate between the parts to be welded so as locally to melt the plastic, and then withdrawing this plate and bringing together the parts to be welded. These welds are performed on a large part of the length of the parts to be fixed to each other. In alternative embodiments these welds are performed all or part of the way along the length of the parts to be fixed together. The rolling up spiral-fashion of the flaps and the welding, notably by hot air nozzles, in order to form the frame members 8 and 9 may all be carried out on a single machine that cuts, scores, folds and welds the blank 30. The welds between the frame members 8 and 9 are preferably made by a process of hot plate welding, but may equally well be made with the aid of hot air nozzles or by addition of material.

In alternative embodiments the ends of the frame members 8 and 9 intended to be welded together are not necessarily oblique, as in the example illustrated in the figures, but may for example be parallel and perpendicular, respectively, to the axes of these frame members.

The box described above fulfils the requirements imposed at the beginning of the description and is recyclable.

For a base 4 with dimensions 400 mm×252 mm, a frame 7 of external dimensions 480×325 mm, a height of the box 2 of approximately 185 mm, and frame members with height 45 mm and thickness 20 mm, the box 2 has a mass of 437 grams and withstands a compression corresponding to 350 kg. The box 2 thus represents a ratio of mass supportable in compression to mass of the box equal to 800. This is a significant benefit in its application to the air transport of mail.

Such a box 2, closed by its lid 3, can support 180 kg on its lid 3 with a lid sag of less than 10 mm. Moreover, when the box is closed by its lid 3, the rim 15 of the latter prevents the side walls 5 and 6 of the box 2 from bowing out under the effect of compression.

The box 2 exhibits these characteristics of very high stiffness and mechanical strength notably owing to the presence and to the structure of the four frame members 8 and 9 and owing to the welding of the tongues 49 to the edges of the adjacent panels 31. It should be observed that the frame members 8 and 9 can be constructed by rolling up the edges of a blank several times so that they can be practically solid and extremely stiff. The assembly 1 formed in this way is totally insensitive to moisture and can be relatively waterproof.

The presence of the handle recesses 10 facilitates the gripping of the box 2. The lining of the flaps 40 and 41 by the double flap 43 prevents a person from injuring himself when carrying the box. Other recesses can of course be provided in the frame members 8 and 9 to facilitate gripping the box.

In addition, the area 25 of a lid 3 allows an adhesive identifying label to be affixed to the lid 3. The striations of this area facilitate the removal of such a label by limiting its adhesion to the board 14. Furthermore, the risk of such a label being removed unintentionally is limited because of the sunken position of the area 25. Lastly, the slots 250 or the stops 21 can be used as guides for binding straps 53 to keep the lid 3 on the box 2, as illustrated in FIG. 5.

As illustrated in FIG. 4, empty boxes 2 similar to that of FIG. 1 can be stacked, in which case the frames 7 of two adjacent boxes 2 rest one on top of the other without contact between the side walls 5 and 6 of the two boxes 2. This feature avoids the risk of jamming between stacked empty boxes 2.

FIG. 5 illustrates the stacking of full boxes 2 closed by their lid 3. For the purposes of such stacking, the base 4 of one box is placed between the locating stops 21 of the lid 3 of a lower box 2. Thus, the stops 21 of the lower box keep the upper box 2 in a central position by encircling its base 4 with slight play. The converging form of the stops 21 helps to guide and centre the boxes 2 during stacking.

FIG. 6 illustrates the stacking of separate lids 3. The widening-out shape of the rims 15 makes such stacking possible and limits the risk of the lids 3 becoming jammed together.

Furthermore, the recesses 24 of one lid 3 then house the stops 21 of a lower lid 3.

More generally, the box 2, which is preferably made of cellular polypropylene, can however be made from other cellular plastics and can of course be used for the transport and/or storage of any type of item. The box 2, or the blank 26, can also be made flame-retardant to suit the requirements of its field of application.

In an alternative embodiment, the frame members 8 and 9 are each formed by rolling up five flaps spiral-fashion.

Figure 7:
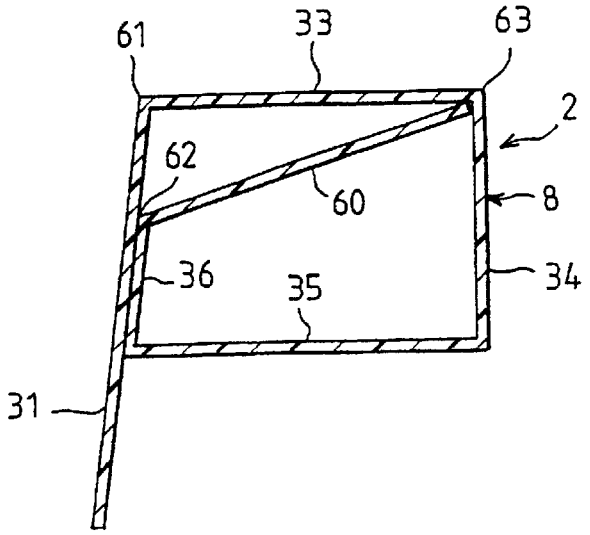
FIG. 7 is an enlarged schematic cross section showing the structure of the frame members of an alternative embodiment of the box according to the invention.

FIG. 7 illustrates the structure of a frame member 8 in this alternative embodiment, while the structure of the other frame members 8 and 9 is analogous. This frame member 8 therefore comprises, by comparison with the embodiment of FIGS. 1 to 6, an additional flap or fifth flap 60 which is extended from the fourth flap 36.

The fifth flap 60 is therefore the terminal flap of the five flaps 33 to 36 and 60 which are extended from the side panel 31.

The fourth flap 36 is shorter, in the cutting plane of FIG. 7, than the fourth flap 36 of the previous embodiment. The fourth flap 36 is welded to the panel 31 at a distance from the fold line 61 separating this panel 31 from the first flap 33.

The first flap 33 and the third flap 35 are roughly horizontal and parallel. The fifth flap 60, joined to the fourth flap 36 along a fold line 62, extends obliquely upwards and away from the box 2, ending at the fold line 63 joining the second flap 34 to the first flap 33.

The fifth flap 60 therefore extends obliquely inside the frame member 8 between the side panel 31 and an angle, formed at the fold line 63, of this frame member 8.

The fifth flap 60 rests in the angle 63 of the frame member 8 and keeps the fourth flap 36 pressed against the panel 31.

It can thus be seen that the stiffness and strength of the frame 7 and therefore of the box 2 are increased by this structure of the frame members 8 and

What is claimed is:

1. A packing box having a polygonal shape and made from a flat plastic blank that is cut and folded, the box comprising:

a base;

outwardly inclined side walls extending upwardly from the base; said side walls being formed from side panels of the blank and being joined together;

an outer reinforcing frame extending around the side walls for holding the box; said outer reinforcing frame comprising frame members joined together and fixed to the side walls; and said frame members being formed from at least four flaps extending from the side panels of the blank and rolled up spiral-fashion.

2. The box according to claim 1, wherein the frame members have lower and upper bearing surfaces.

3. The box according to claim 1, wherein for at least one of the frame members, one of the flaps rolled up to form said at least one frame member is a reinforcing flap that extends obliquely inside said at least one frame member.

4. The box according to claim 3, wherein said at least one frame member is formed from at least five flaps extending from one of the side panels of the blank and rolled up spiral-fashion; said at least one frame member having a terminal flap that forms said reinforcing flap.

5. The box according to claim 1, further comprising a tongue extending from one of the side panels of the blank; said tongue joining together at least two side panels.

6. The box according to claim 5, wherein said tongue is folded and fixed to the other of said adjacent side panels by a weld.

7. The box according to claim 1, wherein the frame members are joined together by a weld.

8. The box according to claim 1, further comprising reliefs on the frame members for holding the box.

9. The box according to claim 1, wherein the blank comprises two outer sheets and an ordered and oriented inner insert arranged between the sheets; said blank defining with said insert a plurality of cells; and said insert being oriented approximately in a direction transverse to the base of the box.

10. The box according to claim 1, wherein the thickness of the outer reinforcing frame is such that the outer reinforcing frame of one empty box can rest on the outer reinforcing frame of another empty box, when said empty boxes are stacked.

11. The box according to claim 1, wherein the blank is a cellular polyolefin blank.

12. The box according to claim 1, wherein the base has dimensions of approximately 400 mm×252 mm, the height of the box is approximately 185 mm, the outer reinforcing frame has external dimensions of approximately 480 mm×325 mm, and the frame members have a height of approximately 45 mm and a thickness of approximately 20 mm.

13. Assembly comprising a box according to claim 1 and a lid for closing said box; said lid comprising a board and a peripheral rim adapted to surround with slight play the outer reinforcing frame, when said box is closed by the lid.

14. The assembly according to claim 13, further comprising locating stops on an outer face of the board; said locating stops designed to surround with slight play the base of another box and thus allow several boxes closed by their lids to be stacked.

15. The assembly according to claim 13, wherein the rim of the lid widens out away from the lid, and the board has on an inner face recesses to house locating stops of another lid to enable several lids to be stacked.

16. The assembly according to claim 13, wherein an outer face of the board of the lid includes a sunken area with reliefs to limit adhesion to said board.

17. The assembly according to claim 13, wherein the lid includes reliefs or depressions to guide binding straps.

* * * * *